US009909227B2

(12) United States Patent
Sundermeier et al.

(10) Patent No.: US 9,909,227 B2
(45) **Date of Patent: *Mar. 6, 2018**

(54) PRETREATMENT OF TINPLATE PRIOR TO THE COATING THEREOF WITH LACQUER

(71) Applicant: HENKEL AG & CO. KGAA, Duesseldorf (DE)

(72) Inventors: Uta Sundermeier, Leichlingen (DE); Michael Wolpers, Erkrath (DE); Marcel Roth, Düsseldorf (DE); Jürgen Stodt, Neuss (DE)

(73) Assignee: Henkel AG & Co. KGaA, Duesseldorf (DE)

( * ) Notice: Subject to any disclaimer, the term of this patent is extended or adjusted under 35 U.S.C. 154(b) by 542 days.

This patent is subject to a terminal disclaimer.

(21) Appl. No.: 13/798,353

(22) Filed: Mar. 13, 2013

(65) Prior Publication Data

US 2013/0192995 A1 Aug. 1, 2013

Related U.S. Application Data

(63) Continuation of application No. PCT/EP2011/072708, filed on Dec. 14, 2011.

(30) Foreign Application Priority Data

Jan. 18, 2011 (DE) ..... 10 2011 002 836

(51) Int. Cl.
*C25D 9/06* (2006.01)
*C25D 11/34* (2006.01)

(52) U.S. Cl.
CPC ..... *C25D 9/06* (2013.01); *C25D 11/34* (2013.01)

(58) Field of Classification Search
CPC . C25D 11/34; C25D 9/06; C25D 5/36; C25D 9/08; C25D 5/48; C25D 11/00; C25D 11/16; C25D 11/08; C25D 9/04; C23C 28/00; C23C 28/04; B41N 3/034; B41N 1/08; B65D 85/72
See application file for complete search history.

(56) References Cited

U.S. PATENT DOCUMENTS 2,312,076 A * 2/1943 Cook ..... C25D 11/34 205/333
2,687,994 A 8/1954 James et al.
3,491,001 A 1/1970 Shackleford et al.
3,616,307 A 10/1971 Snyder
3,658,662 A * 4/1972 Casson, Jr. ..... B41N 1/08 205/208
3,834,999 A 9/1974 Hradcovsky et al.
4,339,310 A 7/1982 Oda et al.
4,448,475 A 5/1984 Reznick
6,174,426 B1 1/2001 Osanaiye
6,361,833 B1 3/2002 Nakada et al.
2002/0054998 A1* 5/2002 Heimann ..... C23C 28/00 428/446
2003/0127024 A1* 7/2003 Heiberger ..... C04B 12/04 106/634
2003/0209290 A1 11/2003 Heimann et al.
2004/0043161 A1 3/2004 Sepeur et al.
2004/0163735 A1 8/2004 Matsukawa et al.
2004/0222105 A1 11/2004 Heimann et al.
2005/0194262 A1* 9/2005 Heimann ..... C25D 9/08 205/704
2006/0228575 A1* 10/2006 Klos ..... C25D 5/48 428/621
2008/0230394 A1 9/2008 Inbe et al.
2008/0280046 A1 11/2008 Bryden et al.
2009/0142589 A1 6/2009 Shoji et al.
2010/0119867 A1 5/2010 Date
2010/0181201 A1 7/2010 Bibber
2010/0203355 A1 8/2010 Kadowaki et al.
2013/0276873 A1* 10/2013 Santori ..... H01L 31/035281 136/255

FOREIGN PATENT DOCUMENTS

CN 1735715 A 2/2006
CN 101384753 A 3/2009
EP 0202870 11/1986
(Continued)

OTHER PUBLICATIONS

International Search Report for PCT/EP2011/072708, dated Mar. 2, 2012, 3 pages.
International Search Report for PCT/EP2011/072769, dated Mar. 12, 2012. All references cited in the International Search Report are listed herein.
Belyanovskaya et al., "Anodic Treatment of Tin in Alkaline Electrolytes," Russian Journal of Applied Chemistry (no month, 2007), vol. 80, No. 1, pp. 74-77.

*Primary Examiner* — Xiuyu Tai
(74) *Attorney, Agent, or Firm* — Mary K. Cameron

(57) ABSTRACT

The invention relates to a method for the anti-corrosive pretreatment of tinplate, in which an anti-corrosive primer coating is applied in a single step, said primer coating effectively preventing the shiny metal surface of the pretreated tinplate from turning black when the pretreated tinplate of the invention that is provided with a topcoat is in contact with liquids releasing or containing sulfur compounds and with food containing protein. In the disclosed method, the tinplate is anodically polarized in an electrolyte containing silicates of formula $M_2O.nSiO_2$, where M is an alkali metal ion or quaternary ammonium ion and n is a natural number between 0.8 and 7. Tinplate pretreated according to the invention can be used in particular for the production of food-safe packaging such as beverage cans or tin cans.

18 Claims, No Drawings

(56) References Cited

FOREIGN PATENT DOCUMENTS

| | | | |
|---|---|---|---|
| EP | 493133 | A2 | 7/1992 |
| EP | 2143822 | A1 | 1/2010 |
| EP | 2186928 | | 5/2010 |
| GB | 479746 | | 2/1938 |
| GB | 1483305 | | 8/1977 |
| JP | 54068734 | A | 6/1979 |
| JP | 56150199 | A | 11/1981 |
| JP | 57070292 | A | 4/1982 |
| JP | 200248398 | A | 12/2000 |
| JP | 208202094 | A | 4/2008 |
| WO | 2008123632 | A1 | 10/2008 |
| WO | 2010057001 | A2 | 5/2010 |

* cited by examiner

PRETREATMENT OF TINPLATE PRIOR TO THE COATING THEREOF WITH LACQUER

The present invention relates to a method for the anti-corrosive pretreatment of tinplate, in which an anti-corrosive primer coating is applied in a single step, said primer coating effectively preventing the shiny metal surface of the pretreated tinplate from turning black when the pretreated tinplate of the invention that is provided with a topcoat is in contact with liquids releasing or containing sulfur compounds and with food containing protein. In the method according to the invention, the tinplate is anodically polarized in an electrolyte containing silicates of the composition $M_2O.nSiO_2$, where M is an alkali metal ion or quaternary ammonium ion and n is a natural number between 0.8 and 7. A subsequent conventional passivation of the tinplate surface can additionally preserve the metallic appearance of the tinplate surface permanently, passivation using an acidic aqueous composition based on a water-soluble compound of zirconium and titanium being particularly effective and offering additional advantages. Tinplate pretreated according to the invention can be used in particular for the production of food-safe packaging, such as beverage cans or tin cans.

Tinplate strip is considered in the food industry to be a suitable material for the production of packaging units for liquids or preserved foods since, owing to the electrochemically inert layer of tin, tinplate releases only small quantities of potentially harmful tin salts to the food product in contact with the tin surface, even over a prolonged period of time. Tinplate strip is therefore an important starting product for food packaging in the steel-processing industry, for example for the production of cans for beverages and preserved soup, fish or meat products. For the production of cans, the packaging industry mainly uses tinplate which is already provided with an organic topcoat to minimize the introduction of iron salts, which can enter the product in the event of damage to the protective tin layer and may have a negative effect on the taste of the food. For the preparation of lacquered tinplate strip, it is necessary to pretreat the tin surface, on the one hand to ensure that the lacquer adheres to the metal surface and on the other hand to provide additional protection against creep corrosion under the lacquer. A suitable pretreatment, which is still widespread in the prior art, is the chromating of the tin surface by bringing the tinplate into contact with an acidic aqueous composition containing chromium salts.

In the development of alternative passivation methods, another property of tinplate should be taken into account, which is always important when foods containing protein are to be stored or packed. Small quantities of low molecular weight sulfur compounds are formed as degradation products of proteins which, as soon as they come into contact with the tin surface of the tinplate, cause the once shiny metal surface to turn black. Since the low molecular weight sulfur compounds, for example $H_2S$, can also diffuse through the organic topcoat, even lacquered tinplate turns black. Although not associated with any significant impairment of lacquer adhesion, these discolorations of the internal surfaces of tinplate cans are undesirable for the food industry as they give consumers the impression that the packaged food is inedible.

In the prior art, pretreatments of tinplate are known which encompass the electrochemical modification of the tin surface and subsequent passivation. The aim of these pretreatment methods described in the prior art, apart from providing a suitable primer coating for corrosion protection, is in particular to ensure the natural color retention of the pretreated and lacquered tinplate products on contact with foods which release sulfur compounds.

GB 479,746 already describes the problem of discoloration of the internal surfaces of containers made of tinplate which are in contact with foods containing protein, and proposes applying an anodic current to the tinplate in an ammoniacal electrolyte, making the tin surface insensitive to discolorations by sulfurous compounds. The tinplates that have been anodically oxidized according to GB 479,746 are then provided with an organic topcoat.

In U.S. Pat. No. 3,491,001, a method for the passivation of tinplates is described, in which an anodic pretreatment in an alkaline electrolyte is followed by a cathodic treatment of the tinplate in an alkaline chromate-containing electrolyte. An electrolytic process chain as described in U.S. Pat. No. 3,491,001 protects the tin surface against corrosion and against turning black on contact with foods which release sulfurous compounds. Electrolytic chromium-containing passivation also acts as a primer for subsequently applied organic topcoats.

From U.S. Pat. No. 4,448,475, an anodic pretreatment of tinplate in an acidic aqueous anolyte is known for improving the adhesion of subsequently applied organic topcoats. The method is said to be particularly applicable and useful in the can industry.

EP 0202870 supplements the teaching of U.S. Pat. No. 4,448,475 with those anolytes which contain stannides and/or stannates.

Regardless of the already existing prior art relating to the modification of tin surfaces for preserving the metallic sheen of the internal surfaces of containers made of tinplate in constant contact with food, there is a need to develop the known methods further in terms of their economic viability and efficiency.

The object of the present invention consists in particular in pretreating tinplate products for the manufacture of food packaging, as far as possible in one step and with the lowest possible loss of tin during pickling in such a way that excellent adhesion of organic topcoats on the tinplate is ensured together with permanent resistance of the pretreated and lacquered tin surfaces to discolorations by sulfidic compounds.

This object is achieved in a method for the electrolytic passivation of tinplate by anodic polarization in an alkaline aqueous electrolyte, wherein the electrolyte contains at least one water-soluble silicate of the composition $M_2O.nSiO_2$, where M is an alkali metal ion or quaternary ammonium ion and n is a natural number between 0.8 and 7.

According to the invention, tinplate is understood to be all tin-plated or tin alloy-plated steel plates.

Salts which are a constituent of the electrolyte in the method according to the invention are considered to be water-soluble within the meaning of the present invention if their solubility in water at a pH value of 8 and a temperature of 20° C. is at least 50 g/l, based on the respective salt.

According to the invention, water-soluble silicates are understood to be compounds of the general empirical formula $M_2O.nSiO_2$, with M as an alkali metal ion or quaternary ammonium ion and n as a natural number between 0.8 and 7, which have a solubility of at least 1 g/l based on $SiO_2$ at a pH value of 8 and a temperature of 20° C.

The alkali metal ions M of the water-soluble silicates are preferably selected from Li, Na and K. In addition, quaternary ammonium ions with aliphatic residues having in each case no more than 10 carbon atoms are equally preferred in electrolytes of the method according to the invention.

Suitable water-soluble silicates are in particular the so-called water glasses, which are produced by melting $SiO_2$ with the respective oxide $M_2O$. Preferred are those water glasses in which the proportion of $SiO_2$ is in the range of 20-40 wt. %. Those water glasses in which the molar ratio of $SiO_2$:$M_2O$ is in the range of 2 to 5, in particular in the range of 3 to 4, are particularly preferred.

The presence of at least one water-soluble silicate in the electrolyte of the method according to the invention has the effect that, during the anodic polarization, a thin silicate layer is produced on the tinplate, which already represents a good primer for subsequently applied organic topcoats. At the same time, the tinplate that has been anodically polarized in this electrolyte and provided with a topcoat displays no significant blackening on contact with sulfur-containing compounds and the metallic sheen of the coated tinplate surface is largely retained. The method according to the invention therefore provides a pretreatment of tinplate products which takes place in one step and modifies tin surfaces in a suitable manner for tinplate to be able to be used as a food packaging material.

The proportion of water-soluble silicates in the electrolyte of the method according to the invention is preferably at least 0.1 wt. %, particularly preferably at least 1 wt. %, in particular at least 2 wt. %, but preferably less than 30 wt. %, particularly preferably less than 20 wt. %, based in each case on the proportion of $SiO_2$. Below a proportion of 0.1 wt. %, based on $SiO_2$ in the electrolyte, the coating weight based on the element Si that can be deposited on the tinplate surfaces during anodic polarization is too low to have a positive effect on adhesion to subsequently applied organic lacquer systems. From a proportion above 30 wt. %, based on $SiO_2$, high-viscosity electrolytes are obtained which are less suitable for the method according to the invention since the coating weight of $SiO_2$ is increased significantly by the electrolyte film adhering to the tinplate surface, so that the result of the pretreatment is difficult to control and, for example, additional rinsing steps or drying steps are necessary before the organic topcoat can be applied to the pretreated tinplate.

The pH value of the electrolyte in the method according to the invention is preferably in a range of 8 to 13, particularly preferably in a range of 10 to 12. In electrolytes with higher alkalinity, the tin layer of the tinplate is corroded, while at pH values below 8, the water solubility of the silicates decreases sharply and $SiO_2$ is increasingly precipitated.

The electrolyte in the method according to the invention can additionally contain at least one organosilane, which itself brings about an improved silicating of the tinplate surfaces and in addition, via a suitable functionality in the non-hydrolyzable organic residue, improves adhesion to subsequently applied organic lacquer systems. In the method according to the invention, those organosilanes that contain at least one hydrolyzable substituent which is split off under hydrolysis as an alcohol having a boiling point of less than 100° C., and at least one non-hydrolyzable substituent, are preferred as constituents of the electrolyte, this non-hydrolyzable substituent preferably having at least some primary amino functions. Most particularly preferably, the organosilane is selected from compounds of the following general structural formula (I):

$$H_2N—[(CH_2)_mNH]_y(CH_2)_n—Si—X_3 \quad (I)$$

wherein the substituents X, each independently of one another, are selected from alkoxy groups with no more than 4 carbon atoms, wherein m and n, each independently of one another, are integers between 1 and 4 and y is an integer between 0 and 4.

The proportion of the organosilanes in the electrolyte of the method according to the invention is preferably in the range of 0.01 to 5 wt. %.

To support the hydrolytic crosslinking of the organosilanes on the tinplate surface, water-soluble aluminum salts that do not contain any halides can be added to the electrolyte of the method according to the invention, preferably in a quantity of at least 0.001 wt. %, but preferably no more than 1 wt. % of aluminum salts in total.

Furthermore, the electrolyte in the method according to the invention can additionally contain at least one organic dicarboxylic acid with no more than 6 carbon atoms, and/or a water-soluble metal salt thereof, which is preferably selected from succinic acid, malonic acid, oxalic acid, glutaric acid, adipic acid and/or alkali metal salts thereof, and is particularly preferably selected from oxalic acid and/or alkali metal salts thereof. The addition of these dicarboxylic acids to the electrolyte has the effect of providing the tinplate surface in the method according to the invention with increased resistance to discoloration on contact with food containing protein.

The proportion of the organic dicarboxylic acids in the electrolyte of the method according to the invention is preferably in the range of 0.01 to 2 wt. %.

As other additives in the electrolyte of the method according to the invention, inert water-soluble salts can be contained, which provide adequate basic conductivity and thus ensure the economic viability of the electrolytic pretreatment method. These inert salts do not take part in the electrode processes (tinplate, cathode) in aqueous solution, i.e. they are not involved in heterogeneous electron transfer reactions and are used exclusively to transport current. Suitable inert water-soluble salts are, for example, carbonates, phosphates, sulfates, nitrates and hydroxides of alkali metals. Inert salts should preferably be added to the electrolyte in the method according to the invention when the specific conductivity of the electrolyte is less than 1 mScm, and in a quantity such that the specific conductivity of the electrolyte lies above this value after adding the inert salt.

The anodic polarization in the method according to the invention preferably takes place at a current density of at least 0.005 $A/dm^2$, particularly preferably of at least 0.1 $A/dm^2$, but preferably no more than 6 $A/dm^2$, particularly preferably no more than 4 $A/dm^2$. Current densities below 0.005 $A/dm^2$ are not capable of suitably modifying the tin surface, i.e. converting mixed oxide present on the surface consisting of tin in the oxidation states +II and +IV into an oxide layer which consists mostly of tin(IV) oxide/hydroxide, and at the same time silicating the tin surface. Conversely, anodic current densities above 6 $A/dm^2$ are disadvantageous within the meaning of the present invention because at these current densities, owing to the semiconductive properties of the tin oxide layer, a large part of the quantity of current is applied to the release of oxygen. On the one hand, this release of oxygen causes a marked reduction in pH at the tinplate surface, so that increased corrosive loss of the tin oxide layer results, and on the other hand, because of the intensive release of gas bubbles, non-homogeneous oxide covering layers are formed with local defects which represent a less suitable primer for organic topcoats. As already described, therefore, it is particularly advantageous to set current densities in the range of 0.5 to 4 $A/dm^2$ in the method according to the invention to ensure low corrosion of the tin coating on the one hand while on the other hand producing an adequate pH shift directly at the tin surface which is sufficient to precipitate dissolved silicate as $SiO_2$, thus causing silicating of the surface.

The duration of the anodic polarization in the method according to the invention is preferably at least 0.2 seconds, particularly preferably at least one second, since with lower polarization times the tin surface mainly undergoes capacitive charge reversal without the flow of an adequate Faraday current which is capable of chemically modifying the tin surface. A polarization period of more than 300 seconds brings no improvement in the properties of the oxide covering layer as a primer coating, even with low current densities. Instead, as the polarization time increases, the amorphousness of the oxide layer appears to increase owing to constant repassivation of the surface, so that in methods with prolonged polarization, lacquer adhesion deteriorates on tinplates that have been pretreated in this way.

The type of anodic polarization can be freely selected in the method according to the invention and can take place for example potentiostatically, potentiodynamically, galvanostatically or galvanodynamically. However, because processability is easier, the galvanostatic application of a current is preferred. A galvanostatic method is therefore also preferred according to the invention since variations in the conductivity of the electrolyte or small changes in the spatial orientation of the tinplate to the cathode have no effect on the electrochemical modification of the tin surface. If the method according to the invention is carried out potentiostatically or potentiodynamically, the generally preferred current densities should each be regarded as time-averaged current densities.

Carrying out a pulse method, in which anodic current or voltage pulses are applied, is also suitable in the method according to the invention, the individual pulse preferably lasting at least 0.2 seconds and the anodic polarization period overall, i.e. totaled over all of the anodic pulses, preferably not exceeding 300 seconds. During the contact of the tinplate with the electrolyte in the method according to the invention, cathodic polarization should preferably be avoided. In the method according to the invention, the electrolyte is preferably brought into contact with the tinplate for anodic polarization by complete immersion of the tinplate in the electrolyte.

Insofar as only tinplate strip which comes directly from the electrolytic production process for tin-plated strip material, and which has not yet been oiled for transport purposes or for subsequent forming, is being treated according to the invention, it is not necessary to clean the tinplate surface before carrying out the method according to the invention. However, if the tinplate strip has already been stored and in particular wetted with anti-corrosive oils or forming oils, a cleaning step is necessary in most cases to remove organic contaminants and salt residues before the tinplate can be anodically pretreated according to the invention. Surfactant cleaning agents known in the prior art can be used for this purpose.

The method according to the invention is distinguished in particular by the fact that tinplate for use as a packaging material in the food industry can be pretreated in a single step in such a way that a tin surface with good adhesion to subsequently applied organic topcoats is present and at the same time the tin surface displays good resistance to black discolorations caused by sulfur on contact with food containing protein. Both lacquer adhesion and resistance to discolorations may optionally be further improved with a conventional post passivation known from the prior art to the person skilled in the art following the pretreatment according to the invention, but in this type of method the advantage of a one-step method is relinquished. In a particularly preferred method according to the invention, therefore, the application of an organic lacquer system takes place immediately after the anodic pretreatment, with or without an intermediate water rinsing and/or drying step.

However, if there is a need for a further improvement of the above-mentioned surface properties, in a further aspect of the present invention a method is preferred in which the anodic pretreatment is immediately followed, with or without an intermediate water rinsing and/or drying step, by a post passivation in which the tinplate that has been anodically polarized according to the preceding statements is brought into contact with an acidic aqueous composition which contains water-soluble inorganic compounds of the elements Zr, Ti, Hf and/or Si, particularly preferably the elements Zr, Ti and/or Si, in particular the elements Zr and/or Ti. As water-soluble inorganic compounds of these elements, in particular the respective fluoro complex salts, fluoro acids and/or salts of the fluoro acids are suitable, particularly preferably the respective fluoro acids and/or salts of the fluoro acids. In a particularly preferred embodiment, the acidic aqueous composition of the post passivation contains at least one water-soluble inorganic compound of the element titanium, which is preferably selected from the respective fluoro complex salts, fluoro acids and/or salts of the fluoro acids of titanium.

The proportion of the water-soluble inorganic compounds of the elements Zr, Ti, Hf and/or Si in the acidic aqueous composition of the post passivation is in total preferably at least 0.001 wt. %, particularly preferably at least 0.01 wt. %, but in total preferably no more than 0.5 wt. %, based on the respective element Zr, Ti, Hf and/or Si, it being further preferred if at least 0.001 wt. %, particularly preferably at least 0.01 wt. %, based on the acidic composition, of water-soluble compounds of the element titanium are contained.

In addition, it is preferred if the acidic aqueous composition of the post passivation contains phosphate ions, preferably with a proportion in the acidic aqueous composition of the post passivation of at least 0.01 wt. %, particularly preferably at least 0.1 wt. %, but preferably no more than 3 wt. %, based on $PO_4$.

Furthermore, the acidic aqueous composition for the post passivation of the anodically pretreated tinplate can contain water-soluble and/or water-dispersible organic polymers, such as for example polyacrylates, polyisocyanates, polyepoxides, polyalkylamines, polyalkylene imines or amino-substituted polyvinylphenol derivatives. If the electrolyte in the anodic pretreatment of the tinplate additionally contains amino-functionalized organosilanes, those water-soluble and/or water-dispersible organic polymers that can be further crosslinked in condensation reactions, i.e. polyisocyanates, polyepoxides and/or mixtures thereof, are preferred.

The total proportion of water-soluble and water-dispersible organic polymers in the acidic aqueous composition of the post passivation in a method according to the invention is preferably in the range of 0.05 to 10 wt. %, particularly preferably in the range of 2 to 5 wt. %.

The pH value of the acidic aqueous composition which is brought into contact according to the invention with the anodically pretreated tinplate is preferably in a range of 2.5 to 5.5.

It is further preferred that the post passivation of the anodically pretreated tinplate be performed electrolessly, i.e. without applying a current.

The anodically pretreated tinplate is preferably brought into contact with the acidic aqueous composition in the so-called "dry-in-place" method, in which a wet film of the acidic aqueous composition is applied onto the tinplate surface and is dried immediately after application. Such a method is particularly suitable for methods according to the invention in which pretreated tin-plated steel strip material is to be post-passivated.

Preferably, therefore, the acidic aqueous composition in the post-passivation step is applied by the so-called coil-coating method, where a moving metal strip is coated continuously. The acidic aqueous composition can be applied by various methods which are common in the prior art. For example, applicator rolls can be used which enable the desired wet film thickness to be adjusted directly. Alternatively, the metal strip can be immersed in the acidic aqueous composition or sprayed with the acidic aqueous composition, after which the desired wet film thickness is adjusted with the aid of squeeze rolls.

After application of the acidic aqueous composition, the tinplate that has been coated in this way is heated to the required drying temperature. The heating of the coated substrate to the required substrate temperature ("peak metal temperature"=PMT) in the range of 120 to 260° C., preferably in the range of 150 to 170° C., can take place in a heated tunnel oven. However, the acidic aqueous composition for the post passivation can also be brought to the appropriate drying or crosslinking temperature by infrared radiation, in particular by near infrared radiation.

A method according to the invention which encompasses both the anodic pretreatment in the silicate-containing electrolyte and the subsequent passivation in the acidic aqueous composition is distinguished by the fact that, because the tin surface has already been silicated in the anodic pretreatment step, a comparatively lower coating weight based on the elements Zr, Ti, Hf and/or Si needs to be applied in the post passivation to achieve excellent properties of the surface as a primer coating.

Accordingly, those methods according to the invention are preferred in which, in the course of the post passivation, a coating weight of at least 0.3 mg/m$^2$, particularly preferably of at least 1 mg/m$^2$, but no more than 20 mg/m$^2$, particularly preferably no more than 10 mg/m$^2$, based on the elements Zr, Ti, Hf and/or Si, results on the tinplate.

In another aspect, the invention relates to the use of tinplate treated by the method according to the invention for the production of packaging, in particular cans, for the storage of foodstuffs.

EXEMPLARY EMBODIMENTS

To illustrate the method according to the invention, cleaned tinplate (tin coating 2.8 g/m$^2$) was first pretreated electrolytically and then rinsed with distilled water, after which a wet film of a passivating agent was optionally applied using a Chemcoater® and dried at 50° C. for 1 min. The corresponding series of tests are listed in Table 1.

The tinplates treated in this way, without a topcoat, were half immersed in a potassium sulfide solution (5 g/l $K_2S$+5 g/l NaOH in water) for 1 min at 90° C., rinsed with water and dried.

The blackening of the tinplates was evaluated optically according to the following scale:

0: no discoloration; metallic sheen
1: individual black discolorations; <10% of the surface
2: speckled black discolorations; <30% of the surface
3: speckled black discolorations; <50% of the surface
4: speckled black discolorations>50% and almost complete loss of metallic sheen
5: speckled black discolorations>50% and complete loss of metallic sheen The results in terms of black discolorations after contact of the sheets with the potassium sulfide solution ("sulfide test") are listed in Table 2.

TABLE 2

Results of the sulfide test

| Test number | Sulfide test/scale 0-5 |
|---|---|
| E1 | 2 |
| E2 | 0 |
| E3 | 2 |
| CE1 | 3 |
| CE2 | 1 |
| CE3 | 3 |
| CE4 | 5 |

It can be seen from Table 2 that, in a direct comparison of methods according to the invention relating to anodic polarization in electrolytes containing water glass with those methods in which the electrolyte is free from water glass, the method according to the invention always gives the better result in the sulfide test (cf. E1-CE1, E2-CE2 and E3-CE3). In addition, it is clear that in a method according to the invention in which no post passivation is carried out (E1), there is already better resistance to black discolorations than in methods for the pretreatment of tinplate which are described in the prior art (CE3). The comparative test CE4 proves the need for anodic polarization even in electrolytes containing water glass.

TABLE 1

Test series for the anodic polarization of tinplate (tin coating weight 2.8 g/m$^2$) and subsequent passivation

| | Anodic polarization | | | |
|---|---|---|---|---|
| Test number | Electrolyte (75 g/l) | Current density/ Adm$^{-2}$ | Time/ seconds | Post passivation |
| E1 | Sodium water glass 37/40 | 1.5 | 60 | — |
| E2 | Sodium water glass 37/40 | 3.5 | 60 | Ti, Zr |
| E3 | Sodium water glass 37/40 | 3.5 | 60 | Cr(VI) |
| CE1 | $Na_2CO_3$ | 1.5 | 60 | — |
| CE2 | $Na_2CO_3$ | 3.5 | 60 | Ti, Zr |
| CE3 | $Na_2CO_3$ | 3.5 | 60 | Cr(VI) |
| CE4 | Sodium water glass 37/40 | −1.5 | 60 | Ti, Zr |

Ti, Zr: Passivation with 7 wt. % Granodine 1456 ® (Henkel) corresponding to 770 ppm Ti and 500 ppm Zr; Coating weight of titanium: 3 mg/m$^2$ measured by X-ray fluorescence analysis (Axios Advanced, Panalytical), corresponding additionally to approx. 2 mg/m$^2$ coating weight of zirconium
Cr(VI): Chromating (0.12 wt. % $CrO_3$); Coating weight of chromium: 3 mg/m$^2$ measured by X-ray fluorescence analysis (Axios Advanced, Panalytical)

What is claimed is:

1. A method for the electrolytic passivation of tinplate by anodic polarization of the tinplate as an anode in an alkaline aqueous electrolyte, wherein the electrolyte contains at least one water-soluble silicate of the composition $M_2O.nSiO_2$, where "M" is an alkali metal ion or quaternary ammonium ion and "n" is a natural number between 0.8 and 7 and proportion of water-soluble silicates in the electrolyte is at least 0.5 wt. % but less than 30 wt. %, based in each case on $SiO_2$; and wherein the at least one water-soluble silicate comprises water glasses having a molar ratio of $SiO_2$:$M_2O$ in a range of 2 to 5; and the anodic polarization takes place at a current density of at least 0.005 A/dm$^2$ but no more than 4 A/dm$^2$ and has a duration of at least 60 seconds such that a silicate layer is produced on the tinplate.

2. The method according to claim 1, wherein the anodic polarization has a duration of no longer than 300 seconds in total and cathodic polarization of the tinplate in the alkaline aqueous electrolyte is absent.

3. The method according to claim 1, wherein the anodic polarization takes place at a current density of at least 0.5 A/dm$^2$ but no more than 4 A/dm$^2$.

4. The method according to claim 2, wherein the anodic polarization takes place galvanostatically.

5. The method according to claim 1, wherein the proportion of water-soluble silicates in the electrolyte is at least 0.5 wt. %, but less than 20 wt. %, based in each case on $SiO_2$.

6. The method according to claim 1, wherein the electrolyte additionally comprises at least one organosilane with at least one hydrolyzable substituent, which is split off under hydrolysis as an alcohol having a boiling point of less than 100° C., and at least one non-hydrolyzable substituent, which has at least some primary amino functions.

7. The method according to claim 6, wherein the at least one organosilane comprises compounds corresponding to the general structural formula (I):

$$H_2N—[(CH_2)_mNH]_y(CH_2)_n—Si—X_3 \quad (I)$$

wherein

X substituents are each independently of one another selected from alkoxy groups with no more than 4 carbon atoms;

m and n, each independently of one another, are integers between 1 and 4; and y is an integer between 0 and 4.

8. The method according to claim 1, wherein the electrolyte additionally contains water-soluble aluminum salts that do not contain any halides.

9. The method according to claim 1, wherein the electrolyte additionally contains organic dicarboxylic acids having no more than 6 carbon atoms, salts of said organic dicarboxylic acids and combinations thereof.

10. The method according to claim 1, wherein the anodic polarization in the alkaline aqueous electrolyte is followed by a secondary passivation comprising contacting the tinplate with an acidic aqueous composition containing water-soluble inorganic compounds of elements selected from the group consisting of Zr, Ti, Hf, Si and combinations thereof, with or without an intermediate water rinsing and with or without an intermediate drying step.

11. The method according to claim 10, wherein the water-soluble inorganic compounds of elements selected from the group consisting of Zr, Ti, Hf, Si and combinations thereof, are present as fluoro acids of said elements, salts of the fluoro acids and mixtures thereof.

12. The method according to claim 11, wherein the water-soluble inorganic compounds are present as the fluoro acids, the salts of the fluoro acids and mixtures thereof of the elements Zr and/or Ti.

13. The method according to claim 11, wherein the acidic aqueous composition additionally contains phosphate ions.

14. The method according to claim 12, wherein the secondary passivation step results in deposition of a coating on the tinplate of at least 0.3 mg/m$^2$, but no more than 20 mg/m$^2$, based on the elements Zr and/or Ti.

15. The method according to claim 14, wherein the secondary passivation takes place by application of a wet film of the acidic aqueous composition on to the tinplate surface, which is dried immediately after application.

16. The method according to claim 8, wherein the electrolyte additionally comprises at least one organosilane with at least one hydrolyzable substituent, which is split off under hydrolysis as an alcohol having a boiling point of less than 100° C., and at least one non-hydrolyzable substituent, which has at least some primary amino functions.

17. The method according to claim 1, wherein the proportion of water-soluble silicates in the electrolyte is at least 0.5 wt. % but less than 20 wt. %, based in each case on $SiO_2$; the at least one water-soluble silicate comprises sodium water glass in which $SiO_2$ is in a range of 20-40 wt. %; and the anodic polarization takes place at a current density of at least 0.5 A/dm$^2$ but no more than 4 A/dm$^2$.

18. The method according to claim 17, wherein immediately after the anodic polarization takes place, with or without an intermediate water rinsing and/or drying step, electrolessly performing a post-passivation step of applying an acidic aqueous composition comprising fluoro complex salts, fluoro acids and/or salts of the fluoro acids of the elements Zr and/or Ti, thereby forming a post-passivation coating having a coating weight of at least 0.3 mg/m$^2$, but no more than 20 mg/m$^2$, based on the elements Zr and/or Ti thereby producing a coated tinplate more resistant to black discoloration from sulfide contact compared to an identical tinplate anodically polarized without the water glass and/or without the post-passivation step.

* * * * *